United States Patent [19]

Yamashita

[11] Patent Number: 4,506,574

[45] Date of Patent: Mar. 26, 1985

[54] ZIGZAG FEEDER FOR BLANKING MACHINE

[75] Inventor: Hisateru Yamashita, Komatsu, Japan

[73] Assignee: Kabushiki Kaisha Komatsu Seisakusho, Tokyo, Japan

[21] Appl. No.: 570,060

[22] Filed: Jan. 12, 1984

[30] Foreign Application Priority Data

Jan. 26, 1983 [JP] Japan ..... 58-008364[U]

[51] Int. Cl.[3] ..... B26D 5/20

[52] U.S. Cl. ..... 83/217; 83/216; 83/215; 83/219

[58] Field of Search ..... 83/219, 216, 217, 215, 83/320

[56] References Cited

U.S. PATENT DOCUMENTS

| | | | |
|---|---|---|---|
| 1,175,198 | 3/1916 | Thomas | 83/215 |
| 3,264,915 | 8/1966 | Peterson et al. | 83/215 X |
| 3,762,260 | 10/1973 | Taniguchi | 83/215 X |
| 4,241,632 | 12/1980 | Seo | 83/560 |

FOREIGN PATENT DOCUMENTS

| | | | |
|---|---|---|---|
| 2158074 | 6/1973 | France | 83/217 |
| 48-44910 | 12/1973 | Japan . | |

*Primary Examiner*—Donald R. Schran

*Attorney, Agent, or Firm*—Armstrong, Nikaido, Marmelstein & Kubovcik

[57] ABSTRACT

A feeder mechanism for feeding a sheet of metal to be blanked in a zigzag fashion in cooperation with a sheet of metal feeder mechanism of a press. A reversible D.C. motor is employed for reciprocating the sheet of metal in a direction at right angles to the sheet of metal feed direction of the press. The forward and reverse rotation and its cycle of the D.C. motor are controlled by a controller in synchronism with the feeding speed of the sheet of metal. The rotational motion of the D.C. motor is translated into a linear reciprocating motion of a die set by a rack and pinion mechanism. The rack is connected to the die set and is reciprocated in a direction at right angles to the sheet of metal feed direction of the press.

2 Claims, 3 Drawing Figures

ZIGZAG FEEDER FOR BLANKING MACHINE

BACKGROUND OF THE INVENTION

This invention relates to a zigzag feeder for blanking by means of a press a sheet of metal in a zigzag form.

In the case a sheet metal is blanked by means of the conventional press in a zigzag configuration, the required power is taken out from a cam interlocked mechanically with the press to reciprocate the die set in the directions at right angles to the direction of feed of sheet metals. This method is, however, disadvantageous in that upon alteration of the zigzag stroke it requires an extended time to loosen lock nuts to thereby change the zigzag stroke, and because of its complicated structure, lock nuts tend to loosen in operation thus resulting in inaccurate blanking work.

SUMMARY OF THE INVENTION

It is therefore an object of the present invention to provide a feeder mechanism for feeding a sheet of metal to be blanked in a zigzag fashion which overcomes the above noted problems of the prior art.

Another object of the present invention is to provide a feeder mechanism for feeding a sheet of metal to be blanked in a zigzag fashion in which a D.C. motor is employed for reciprocating a die set in a direction at right angles to the sheet of metal feed direction of a press.

In accordance with an aspect of the present invention, there is provided a feeder mechanism for feeding a sheet of metal to be blanked in a zigzag fashion in cooperation with a sheet of metal feed means of a press, comprising: a die set of the press; a rack connected to said press, said rack extending in a direction at right angles to the feed direction of the sheet of metal in the press; a D.C. motor; means for translating a rotational motion of said D.C. motor into a linear motion of said rack; and controller means for controlling rotational direction of said D.C. motor forwardly and reversely at a preset cycle thereby reciprocating said rack and said die set in a direction at right angles to the feed direction of the sheet of metal.

The above and other objects, features and advantages of the present invention will be readily apparent from the following description taken in conjunction with the accompanying drawings.

DESCRIPTION OF THE PREFERRED EMBODIMENT

Figure 1:
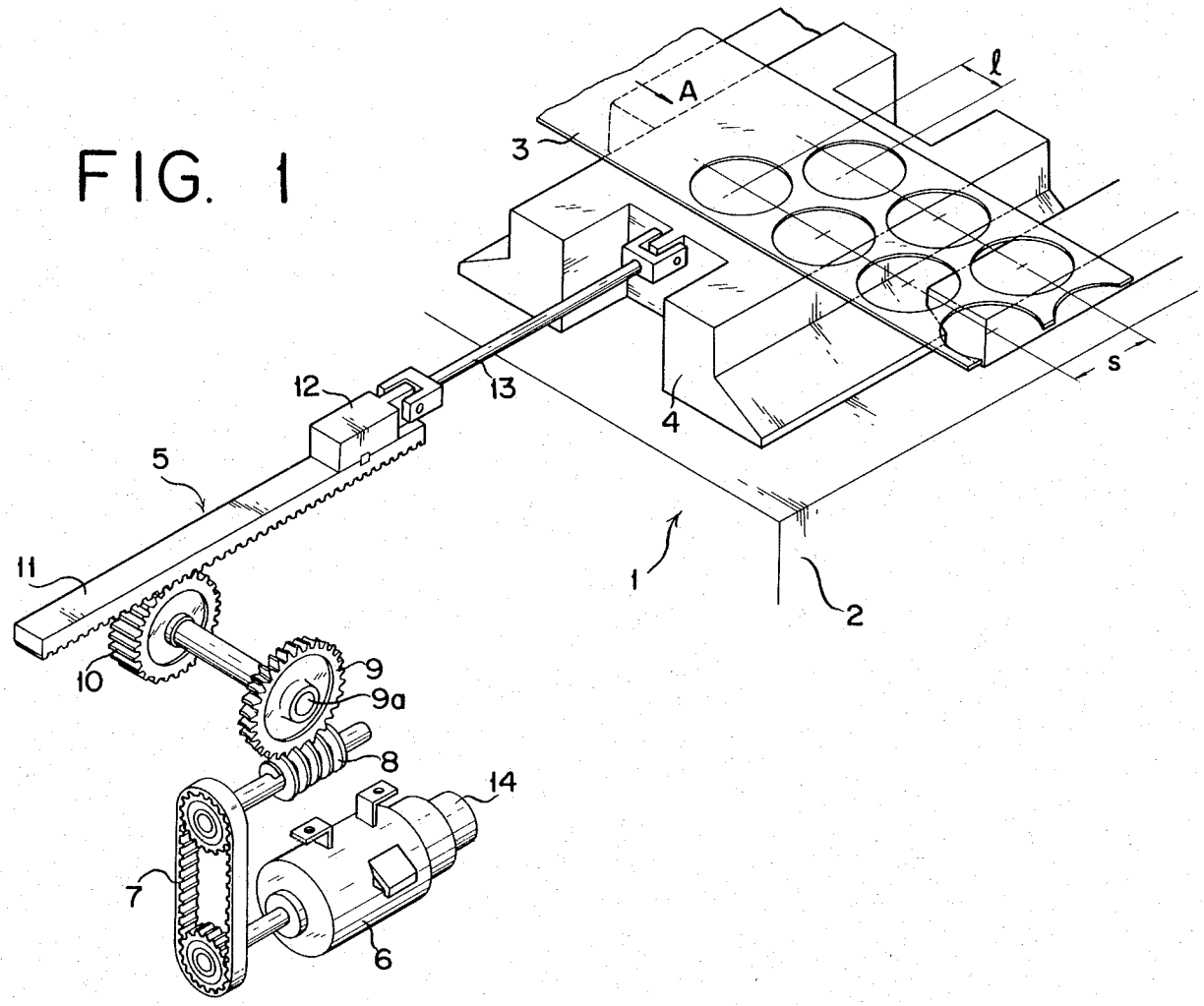
FIG. 1 is a perspective view of a feeder mechanism according to the present invention.

The present invention will now be described by way of example only with reference to the accompanying drawings. In FIG. 1, reference numeral 1 denotes a press installed on a coil line, not shown, which includes a die set 4 placed on a bed 2 and that can be moved freely in the directions at right angles to the direction of feed of sheets of metal 3 shown by an arrow A. The die set 4 is adapted to blank the sheet of metal 3 in cooperation with a punch fitted to a slide, not shown, and is arranged to reciprocate by the action of a zigzag feed mechanism 5 in the directions at right angles to the direction of movement of the sheet of metal 3.

Further, the zigzag feed mechanism 5 includes a D.C. motor 6 whose rotation is transmitted through a timing belt 7 to a worm gear 8. The worm gear 8 meshes with a worm wheel 9 whose shaft **9*a* has a pinion 10 fixedly secured thereto. The pinion 10 meshes with a rack 11 disposed in the direction of movement of the die set 4. The rack 11 has a holder 12 fitted thereto and which is connected to the die set 4 by means of a connecting rod 13. The die set 4 is reciprocated by the zigzag feed mechanism 5 as will be described below. In FIG. 1, reference numeral 14 denotes a rotation detector such as a pulse encoder adapted to detect the rotation of the D.C. motor 6** or the like.

Thus, when the press 1 is started to blank the sheet of metal 3 in zigzag form, a start signal is generated thereby rotating the D.C. motor 6 forwardly and reversely at a preset speed and a cycle. The rotation of the D.C. motor 6 is transmitted through the timing belt 7, the worm gear 8 and the worm wheel 9 to the pinion 10 to thereby rotate the pinion 10 forwardly and reversely and reciprocate the rack 11 at a preset zigzag stroke S. The reciprocation of the rack 11 is transmitted through the connecting rod 13 to the die set 4 so that the die set 4 may be reciprocated in the directions at right angles to the direction of feed of the sheet of metal 3 at the zigzag stroke S thereby blanking the sheet of metal between the punch fitted to the slide and the die set 4. The sheet of metal 3 can be blanked in zigzag form by synchronizing the amount of feed "l" of the sheet of metal 3 with the reciprocation of the die set 4. In brief, for example, the movement of the die set 4 and the feed of the sheet of metal 3 commences at a crank angle 240° of the press 1, and the movement and feed are stopped at a crank angle of 120°. The blanking of the sheet of metal 3 is made in the range of crank angles from 120° to 240°. By repeating the aforementioned actions, the sheet of metal 3 can be blanked continuously in zigzag form.

Figure 2A:
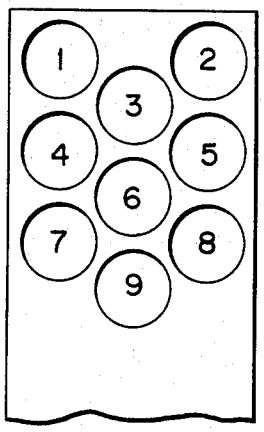
FIGS. 2A and 2B are views explanatory of hole-blanking order in a plural rows.
Figure 2B:
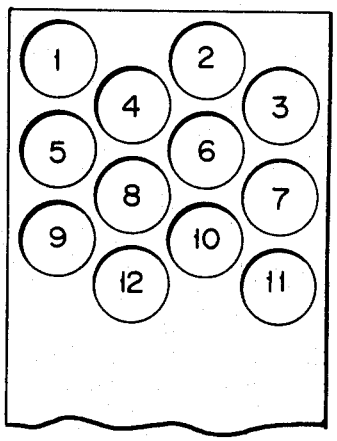

Whilst, when it is desired to change the zigzag stroke, it is only necessary to set a stroke setting switch, not shown, at a desired stroke value. The value of stroke thus set is fed to a control unit adapted to control the D.C. motor 6 together with a signal transmitted by a rotation detector for detecting the rotation of the D.C. motor 6 thereby calculating a new stroke on the basis of the deviation between the two and controlling the rotation of the D.C. motor 6 so as to obtain a newly set zigzag stroke. According to this method, the zigzag stroke S can be varied freely at an order of 0.1 mm, and a multi-stage blanking in zigzag form as shown in FIG. 2A and FIG. 2B can be made. Numerals in FIGS. 2A and 2B indicate the blanking sequence.

As described in detail hereinabove, the present invention has a D.C. motor serving as an independent power source from the press and is arranged to enable the sheet of metal to be blanked in zigzag form by reciprocating the die set in the directions at right angles to the direction of feed of the sheet of metal by the action of the D.C. motor in synchronism with the feed of the sheet of metal and does not require a complicated conventional power transmission means wherein the required power is taken out from the press thereby improving the reliability in operation. Further, only by setting the zigzag stroke and the number of rows to be blanked by means of a controller, a switch and detectors, it becomes possible to set a zigzag stroke with a high accuracy, and therefore the stroke can be changed readily and also the yield of the material can be improved.

It is to be understook that the foregoing description is merely illustrative of a preferred embodiment of the invention and that the invention is not to be limited thereto, but is to be determined by the scope of the appended claims.

What is claimed is:

1. A feeder mechanism for feeding a sheet of metal to be blanked in a zigzag fashion in cooperation with a sheet of metal feed means of a press, comprising:

a die set of the press;

a rack connected to said press, said rack extending in a direction at right angles to the feed direction of the sheet of metal of the press;

a D.C. motor;

means for translating a rotational motion of said D.C. motor into a linear motion of said rack; and controller means for controlling rotational direction of said D.C. motor forwardly and reversely at a preset cycle thereby reciprocating said rack and said die set in a direction at right angles to the feed direction of the sheet of metal.

2. A feeder mechanism according to claim 1 wherein said rotational to linear motion translating means comprises a pinion in mesh with said rack and wherein said mechanism further comprises means for reducing output speed of said D.C. motor.

* * * * *